United States Patent [19]

Bair

[11] 4,080,023

[45] Mar. 21, 1978

[54] COLLAPSIBLE MULTIPLE SHELF FILE

[76] Inventor: Carl J. Bair, 5150 Balboa Arms Dr. No. E6, San Diego, Calif. 92117

[21] Appl. No.: 749,824

[22] Filed: Dec. 13, 1976

[51] Int. Cl.[2] ..... B65D 13/04

[52] U.S. Cl. ..... 312/259; 206/491; 229/23 R

[58] Field of Search ..... 220/23 R, 28 R, 29 B, 220/345; 206/491; 211/135; 312/108, 111, 259, 261, 232

[56] References Cited

U.S. PATENT DOCUMENTS

| | | | |
|---|---|---|---|
| 1,592,497 | 7/1926 | Mays | 312/234.4 |
| 2,904,382 | 9/1959 | Mitten | 312/261 |
| 3,189,247 | 6/1965 | Wischusen | 229/28 R |
| 3,628,842 | 12/1971 | Wright | 312/259 |

*Primary Examiner*—Casmir A. Nunberg

*Attorney, Agent, or Firm*—Brown & Martin

[57] ABSTRACT

A collapsible multiple shelf file is constructed of a sheet of cardboard or the like, cut and scored to define a plurality of panels foldable into an open front box-like structure having double side walls with inner sidewalls having slots for receiving a plurality of shelf panels. The side panels are double with inner panels that overlap and extend to the inside of the outer panels and further overlap flaps which extend downward from the top panel and similar flaps which extend upward from the bottom panel. The outer side panels are formed with rectangular cuts for defining a loop for receiving and holding stacked material such as envelopes. The top panel includes cut circles which can be punched out for receiving tubular members for holding pencils and the like. The shelf sheets or panels are provided with a stop member which may be folded upward to stop short forms or sheets of paper.

10 Claims, 6 Drawing Figures

COLLAPSIBLE MULTIPLE SHELF FILE

BACKGROUND OF THE INVENTION

The present invention relates to filing structures and pertains particularly to a collapsible multiple shelf file.

In many professions, a number of different forms are used in carrying out the practice. It is desirable that such forms be readily available for convienent access when needed. Usually such forms are carried or kept in a filing cabinet in a supply or storage room. Such files are normally space consuming and not readily available at the desk of the person needing them.

It is desirable that there be available a collapsible multiple shelf file that is compact, sturdy, and lightweight that is also easy to assemble and to knock down and store.

SUMMARY AND OBJECT OF THE INVENTION

Accordingly, it is the primary object of the present invention to provide a simple and practical multiple file which is simple and easy to assemble and quick and easy to disassemble for storage.

Another object of the invention is to provide a multiple shelf file that is compact, sturdy, and, light in weight.

A further object of the present invention is to provide a practical and inexpensive multiple shelf file that is simple and inexpensive to manufacture, that is compact and easy to ship, and is easy to assemble and disassemble.

In accordance with the primary aspect of the present invention, a multiple shelf structure comprises a sheet of paperboard or like material cut and scored for defining a plurality of panels connected along lines of fold for folding into an open front box-like structure having side panels defining multiple shelf support means for receiving a plurality of shelf panels. The structure includes double side panels with inner panels having slots for receiving the shelves and slotted overlapping flaps of the bottom and top panels which interlock between the double side panels and hold the top and bottom panels in place.

BRIEF DESCRIPTION OF THE DRAWING

The above and other objects and advantages of the present invention will become apparent from the following description when read in conjunction with the drawings wherein.

DETAILED DESCRIPTION OF THE PREFERRED EMBODIMENT

Figure 1:
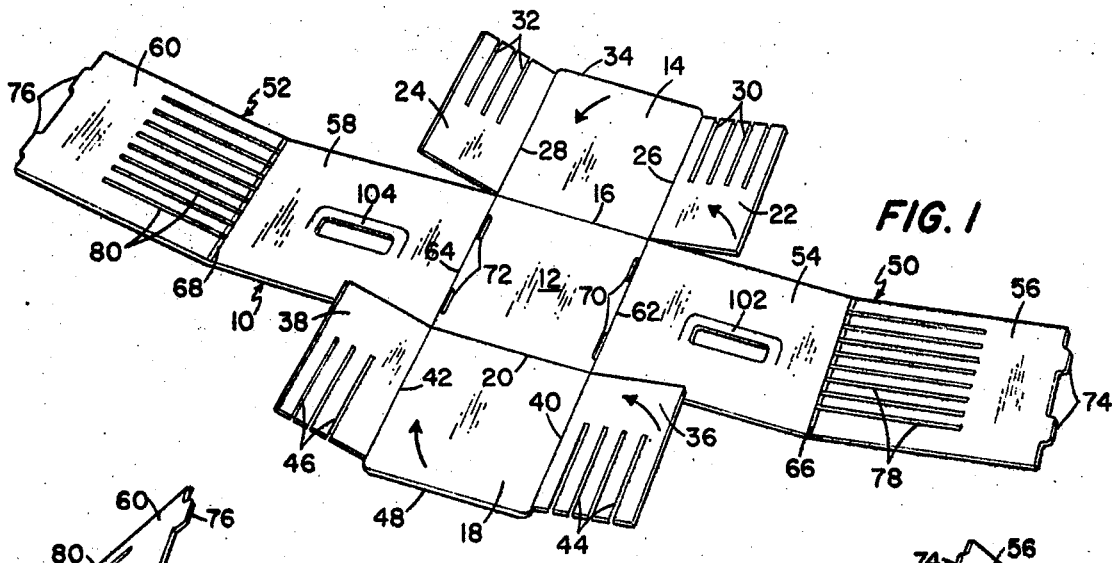
FIG. 1 is a perspective view of a sheet of material forming the support structure of the present invention.

Turning to the drawing and particularly to FIG. 1, there is illustrated a sheet of paperboard material, such as cardboard, generally designated by the numeral 10 which has been cut and scored in accordance with the present invention to define a multiple panel arrangement which when folded together defines an open front, multiple shelf support structure. While any number of suitable materials can be used for the subject structure, cardboard is preferred because of its light weight and strength to weight ratio. The structure as illustrated is cut and scored to define a generally rectangular back panel 12 with a top panel 14 connected thereto along a scored line or fold 16 and a bottom panel 18 connected thereto along a scored line or fold 20.

The top panel 14 includes a pair of flaps 22 and 24 connected thereto by means of scored lines of fold 26 and 28. These flaps include a plurality of spaced parallel slots 30 and 32. The top panel also includes a front tab 34.

The bottom panel is similar to the top panel and includes a pair of side flaps 36 and 38 connected to the bottom panel along scored lines or folds 40 and 42. Similarly, a plurality of slots 44 and 46 are formed in the bottom panel flaps 36 and 38. The bottom panel 18 also includes an extension 48 at the outer edge therefor for receiving labels and the like.

Figure 3:
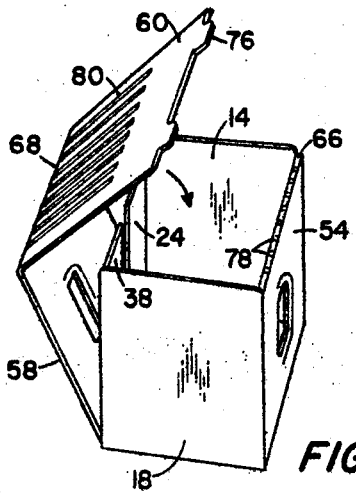
FIG. 3 is a view like FIG. 2 with the structure in the further stage of assembly.
Figure 4:
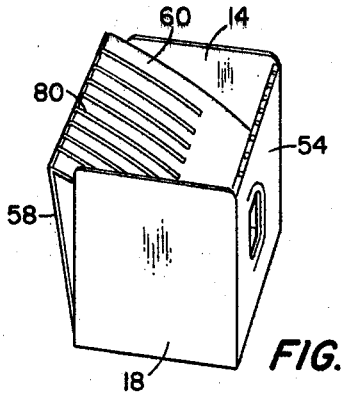
FIG. 4 is a view like FIG. 3 with the structure in a still further stage of assembly.

The sheet defines a pair of double side panels designated generally by the numerals 50 and 52, the panel 50 comprising outer panel 54 and inner panel 56 and the panel 52 comprising an outer panel 58 and inner panel 60. The outer panels are referred to as outer panels because they are on the outside of the assembled carton, whereas the inner panels are on the inside of the assembled box-like structures. The panels are connected along scored fold lines 62 and 64 to the sides of the back panel 12 and the respective inner and outer panels are connected together by means of double scored fold lines 66 and 68 respectively. These two lines 66 and 68 are double lines spaced slightly apart to provide shelf receiving and support slots for sliding shelves. A pair of locking slots 70 and 72 respectively are formed at the edges of the back panel 12 adjacent the fold lines for the side panels. The inner side panels 56 and 60 include pairs of tabs 74 and 76 respectively, which engage the slots 70 and 72 respectively, when in the assembled condition. The inner side panels include a plurality of shelf receiving slots 78 and 80 which extend from the respective fold lines 66 and 68 along to approximately two-thirds the length of the inner side panels. These slots appear on the inside of the structure as seen in FIGS. 3 and 4, when the structure is assembled.

Figure 5:
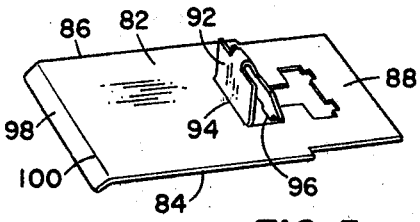
FIG. 5 is a perspective view of a typical shelf.

Turning now to FIG. 5, there is illustrated a shelf panel 82 for inserting into the assembled structure. The shelf panel is constructed of material such as cardboard, plastic or the like, with a pair of side edges 84 and 86 extending outward to a width slightly greater than the back portion of the board, such that the portions 84 and 86 engage the slots 78 and 80 in the side panels when the shelves are slipped into position. The back portion 88 of the shelf 82 is of a slightly narrower width and extends past the slots in the side panels and abutts the back panel 12.

The shelf panel 82 includes stop means 92, which can be incorporated in any or all of the shelves. This stop means is a generally H-shaped partial cut out which is cut except along a fold line 94, such that the device may be punched out and return folded up, so that tabs 96 extend into the slot adjacent the fold line to define an upward extending stop member. The stop 92 can be placed at different distances from the front edge of the shelf panel, so as to stop various sizes of paper at the fold line 94. Thus with this stop structure in place, various sized sheets, forms or papers may be inserted in the shelves without slipping beyond the front of the shelves to where they cannot be easily retrieved.

Figure 2:
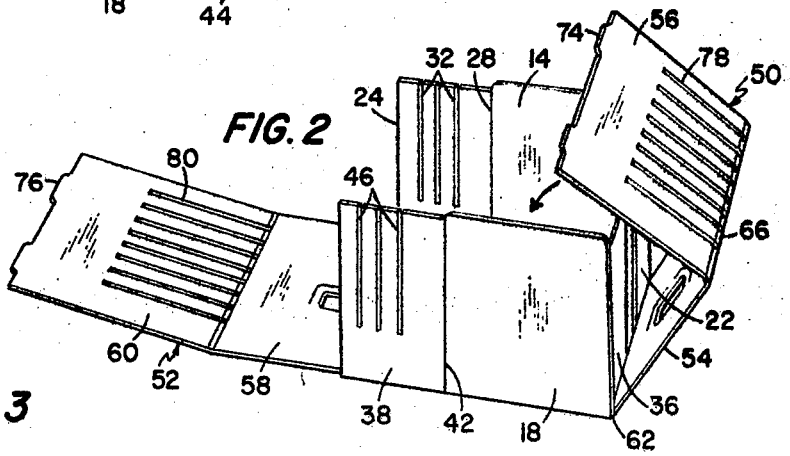
FIG. 2 is a perspective view of a sheet of FIG. 1 partially assembled.

In assembling the structure of the present invention, the sheet as seen in FIG. 1 may be rested, for example, on a flat horizontal surface and the top and bottom panels folded upwards as seen in FIG. 2 with the flaps 22 and 36 respectively folded to extend along fold line 62. The side panel 50 is then folded upward as shown in FIG. 2 with the outer panel 54 extending upward on the outside of flaps 22 and 36 and the inner panel 56 extending over flaps 22 and 36 and down into the box structure, with tabs 74 extending into slots 70. This locks the double side panels into position as seen in FIG. 3, and also locks the flaps 22 and 36, because they do not have sufficient clearance inside the double folded edge portion at 66 to allow the top and bottom panels to swing or be pulled outwardly. Thereafter, the other side of the structure is folded upward and in a similar manner as shown in FIG. 4, with the inner panel 60 folded over the side flaps 24 and 38 and downward into the box structure with the tabs 76 extending into the slots 72. This forms the support structure.

Figure 6:
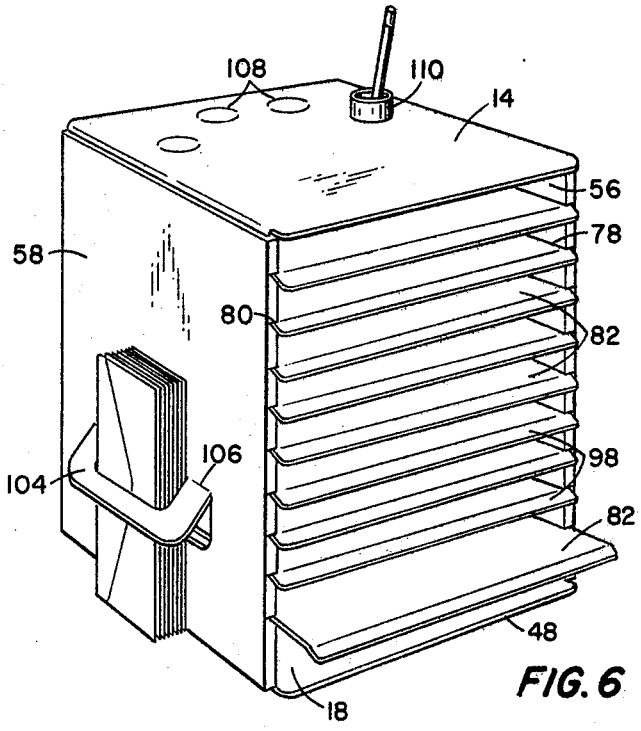
FIG. 6 is a perspective view of the entire shelf file assembled.

The box-like support structure may then be tilted upward to rest on the bottom 18 and a plurality of shelves 82, inserted into the slots 78 and 80 as seen in FIG. 6. The shelves 82 may be prepared by folding the tab 98 on the forward edge thereof downward along fold line 100, prior to insertion into the support structure. The tab 98 provides a convenient means for grasping and pulling the shelf outward as well as means for receiving labels and the like. Also any shelf which is expected to contain shorter than full length sheets may be conditioned with stop means 92 folded into the stop position. In addition to the shelf itself, a slip sheet may rest on the shelf with a tab overlying tabs 98 such that the slip sheet may be used to pull the forms and materials in the shelf outward without pulling the shelf itself outward. This provides ready access to the materials in the file. Such a slip is especially desirable for the bottom shelf which does not itself slide outward, like the shelves about it.

Each of the side panels 54 and 58 as seen in FIG. 1 may also be provided with loops 102 and 104 formed by means of cuts extending around three sides of a rectangle. Either loop may be pressed outward on fold line 106, as shown in FIG. 6, providing a convenient holder for envelopes and the like as illustrated.

Additional features may include a plurality of incomplete circular cuts 108 in the top panel 14. These cuts may be punched out to receive cylindrical tubes 110, as exemplified in FIG. 6. These tubes may then be used for storage of pencils and the like.

The sheet and shelves may be colored in any desirable color or pattern such as wood grain or the like.

While the present invention has been illustrated and described by means of specific embodiments, it is to be understood that numerous changes and modifications may be made therein without departing from the spirit and scope of the invention as defined in the appended claims.

Having described my invention, I now claim.

1. A collapsible shelf support structure comprising:

a sheet of material cut and scored for defining a plurality of panels connected by lines of fold and extending outwardly from a central unitary panel defining a back panel, said plurality of panels including top and bottom panels connected along lines of fold to said back panel, a pair of double overlapping side panels defined by an outer side panel contiguous to said back panel and an inner side panel connected to the outer side panel along a line of fold and foldable inward toward said back panel and including a plurality of slots extending from said line of fold inwardly for slideably supporting a plurality of slidable horizontal shelves, said sheet being foldable into a self supporting box-like shelf supporting structure having an open front for slideably receiving a plurality of sheet shelves in said slots.

2. The structure of claim 1 wherein said top panel and said bottom panel each includes a pair of side flaps for extending between and locking into each of said inner and outer side panels.

3. The structure of claim 1 wherein each of said inner side panels includes tabs at the end thereof for extending into locking slots in said back panel.

4. The structure of claim 2 wherein said flaps include slots aligned with slots in said side panels.

5. A collapsible shelf support structure comprising:

a sheet of paperboard material cut and scored for defining a plurality of panels connected by lines of fold and extending outwardly from a central panel defining a back panel, said plurality of panels including top and bottom panels connected along lines of fold to said back panel, a pair of double overlapping side panels defined by an outer side panel contiguous to said back panel and an inner side panel foldable inward toward said back panel and including a plurality of slots for supporting a plurality of slideable horizontal shelves, said sheet being foldable into a self supporting box-like shelf supporting structure having an open front for receiving a plurality of sheet shelves in said slots, said top panel and said bottom panel each including a pair of side flaps for extending between and locking into each of said inner and outer side panels, said flaps including slots aligned with slots in said side panels, and a plurality of shelf panels extending into a plurality of said slots.

6. The structure of claim 5 wherein said slots are less than the width of said side panels and said shelf panels include a portion engaging said slots and a portion extending beyond said slot to said back panel.

7. The structure of claim 6 wherein each of said shelf panels includes a tab at the forward end thereof for grasping and for pulling said shelf out, and for receiving and displaying a label.

8. The structure of claim 6 including a slip sheet on at least one of said shelves for pulling the contents of said shelf outward independent of said shelf.

9. The structure of claim 5 wherein at least one of said shelf panels includes stop means spaced from the forward edge thereof, said stop means defined by a partial cut out in said shelf so that said tab extends upward from the surface of said shelf, with an end thereof extending downward and engaging a portion of the shelf.

10. The structure of claim 8 including a plurality of round cuts in said top panel for punching out of said panel for receiving a cylindrical tube for holding pencils and the like, and;

wherein each of said outer side panels include a pair of parallel substantially rectangular cuts for defining a loop for receiving and supporting articles at the end thereof.

* * * * *